United States Patent [19]

Sobol, III

[11] 4,354,068

[45] Oct. 12, 1982

[54] LONG TRAVEL ELASTOMER KEYBOARD

[75] Inventor: Anthony J. Sobol, III, Lubbock, Tex.

[73] Assignee: Texas Instruments Incorporated, Dallas, Tex.

[21] Appl. No.: 118,284

[22] Filed: Feb. 4, 1980

[51] Int. Cl.[3] ..... H01H 13/70

[52] U.S. Cl. ..... 200/5 A; 200/159 B; 200/292

[58] Field of Search ..... 200/5 R, 5 A, 86 R, 200/1 R, 292, 340, 159 B

[56] References Cited

U.S. PATENT DOCUMENTS

| | | | |
|---|---|---|---|
| 3,860,771 | 1/1975 | Lynn et al. | 200/5 A |
| 3,911,234 | 10/1975 | Kotaka | 200/5 A |
| 4,066,851 | 1/1978 | White et al. | 200/86 R X |
| 4,156,802 | 5/1979 | Gilano et al. | 200/340 |
| 4,180,711 | 12/1979 | Hirata et al. | 200/292 X |
| 4,245,138 | 1/1981 | Harper | 200/292 X |

*Primary Examiner*—James R. Scott

*Attorney, Agent, or Firm*—James P. McAndrews; John A. Haug; Melvin Sharp

[57] ABSTRACT

A flexible data entry keyboard is disclosed which is formed using a flexible substrate having conducting stripes and switch points thereon. The flexible substrate may be folded back on itself such that the switch points are facing one another in opposed complementary relation. An insulating substrate is positioned between the substrates and has a plurality of apertures in alignment with said switch points. To provide a long travel and high tactile feedback characteristic, an elastometer substrate is positioned over the top of said flexible substrate and has domes thereon which overlay each of said switch points. The domes have actuation surfaces on their underneath side such that when a force is applied to the dome, the dome is compressed and deformed against the switch points and the actuation surface ensures that a reliable and consistent contact is made. When the force is removed, the dome snaps back to its original shape, thereby providing high tactile feedback and assurance to the user that contact has been made.

7 Claims, 7 Drawing Figures

LONG TRAVEL ELASTOMER KEYBOARD

BACKGROUND OF THE INVENTION

This invention relates to keyboards and more particularly to a long travel, high tactile feedback keyboard and method of making same.

Many of the current keyboards used in commercial calculators today are mechanical in nature and consist of numerous metal strips and springs that provide the switch mechanism and tactile feedback. This type of mechanical configuration has some severe limitations in that it produces keyboards which have poor reliability, high cost and high labor content. Other types of keyboards, such as that disclosed in U.S. Pat. No. 4,081,898 entitled "Method of Manufacturing an Electronic Calculator Utilizing a Flexible Carrier", solves some of these problems in that this type of calculator uses a flexible substrate carrier folded back upon itself with an insulator therebetween; the flexible substrate has protuberances located thereon with a conductor strip on the underneath side such that when the protuberance is depressed, an electrical connection is made. This type of keyboard has improved the reliability and reduced the cost of keyboards to some extent but is not desirable for business-type data entry machines or calculators in which the operators that use these type machines apply the touch method and therefore need to use keyboards which have a long travel distance and high tactile feedback characteristic. In other words, the key must snap back such that the operator has assured himself that in fact an input (or electrical connection) has been made. Utilizing keyboards which have a short travel distance will not give the operator the feeling of confidence that an input or electrical connection has been made.

SUMMARY OF THE INVENTION

Accordingly, it is an object of the present invention to provide a long travel keyboard which has a high tactile feedback which can be used in a terminal, calculator, computer, typewriter or similar type machine.

Another object of the present invention is to provide a keyboard which is extremely reliable, yet inexpensive to manufacture.

Another object of the present invention is to provide a keyboard which is simple in design with a minimum number of mechanical parts.

Another object of the present invention is to provide a method of manufacture of a long travel, high tactile feedback keyboard.

DESCRIPTION OF THE DRAWING

Other objects and features of the invention will become more readily understood from the following detailed description and appended claims when read in conjunction with the accompanying drawings, in which like reference numerals designate like parts throughout the FIGURES thereof, and in which:

DESCRIPTION OF THE PREFERRED EMBODIMENTS

Figure 1A:
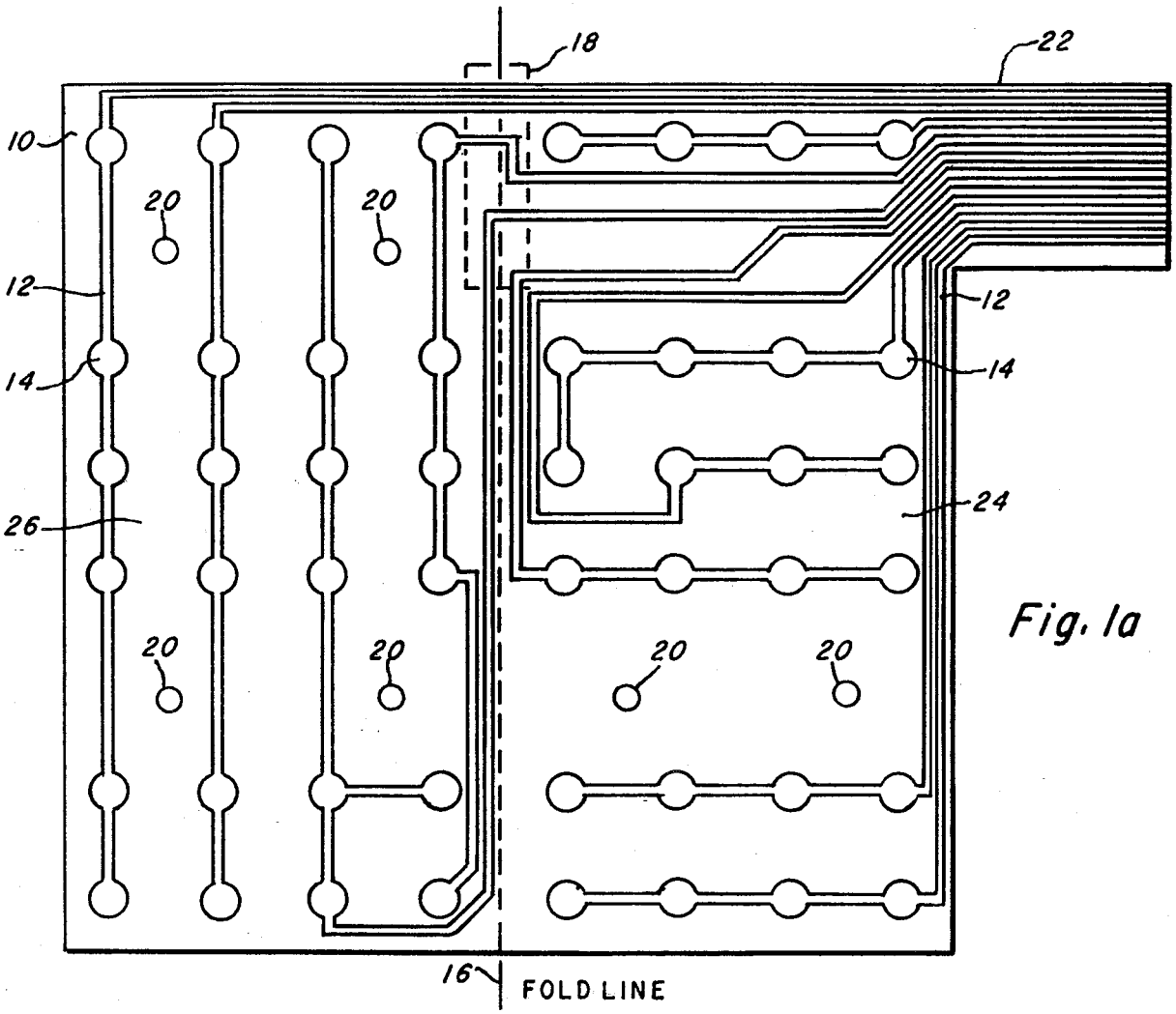
FIG. 1A is a plan view of the flexible substrate with the conducting stripes and switch points attached thereto.
Figure 1B:
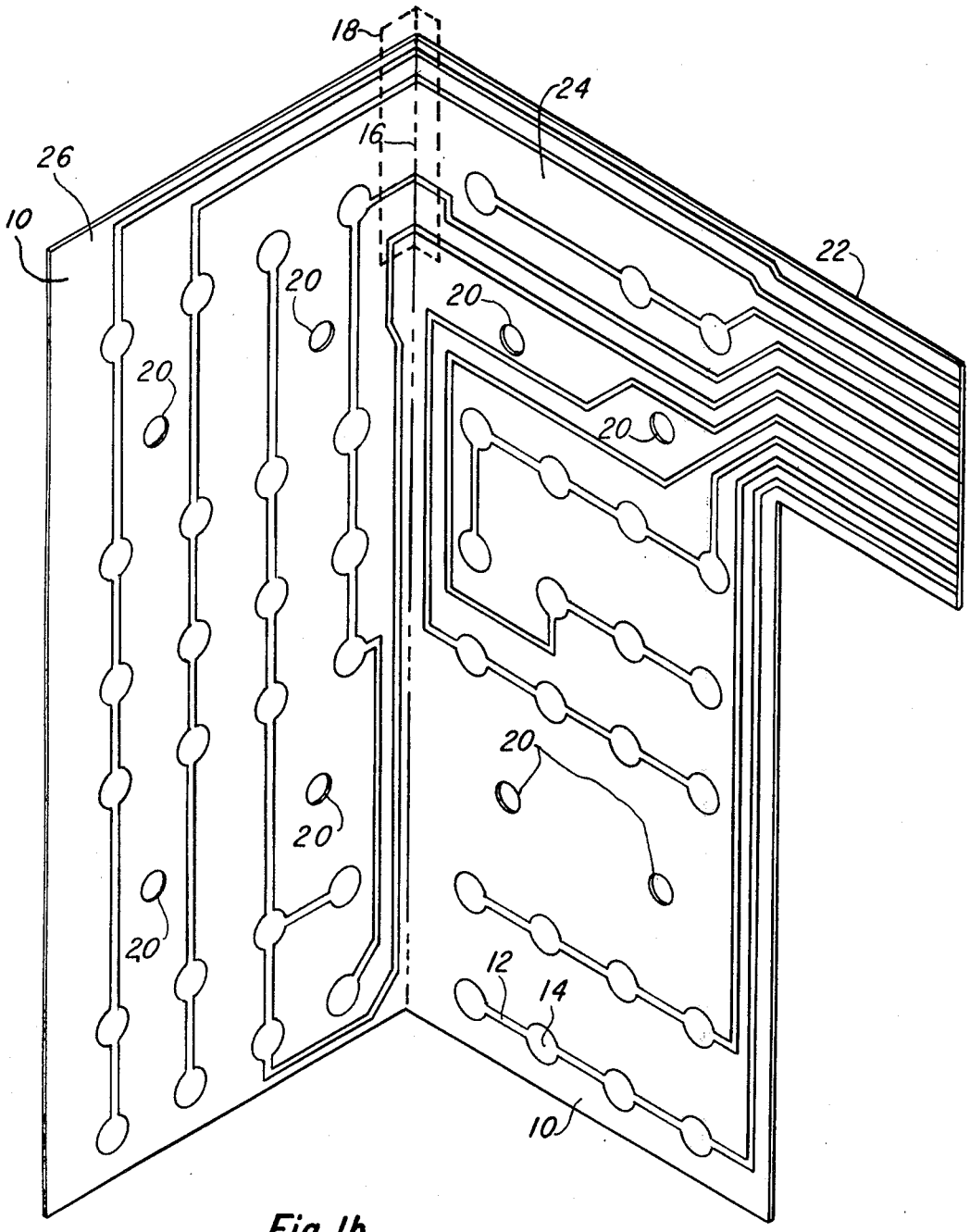
FIG. 1B is a perspective view of the flexible substrate partially folded along its fold line.

Referring now to FIG. 1A, a flexible substrate 10 is utilized as the base material. Substrate 10 may be, for example, an organic film such as polyester sold under the trade name Mylar by the DuPont Company or a polyimide sold under the trade name Kapton by the DuPont Company and having a thickness of about two to fifty mils, but preferably, two to five mils. Conductor patterns 12 and switch points 14 are formed on substrate 10 in a manner well known in the art; for example, conducting strips 12 and switch points 14 may be formed on substrate 10 by selectively screening on a conductive ink. Substrate 10 is then folded along fold line 16 such that the switch points are facing one another and are in an opposed complementary relation. Alternatively, the flexible substrate may be formed of two independent substrates 24 and 26 with jumper wires or other appropriate electrical conductive means interconnecting the conductors traversing box 18 on the two substrates. Registration holes 20 are utilized to ensure proper registration of switching points 14. Connector tab 22 is utilized to connect electrically the keyboard with the other portion of the machine. FIG. 1B illustrates flexible substrate 10 partially folded along fold line 16.

Figure 2:
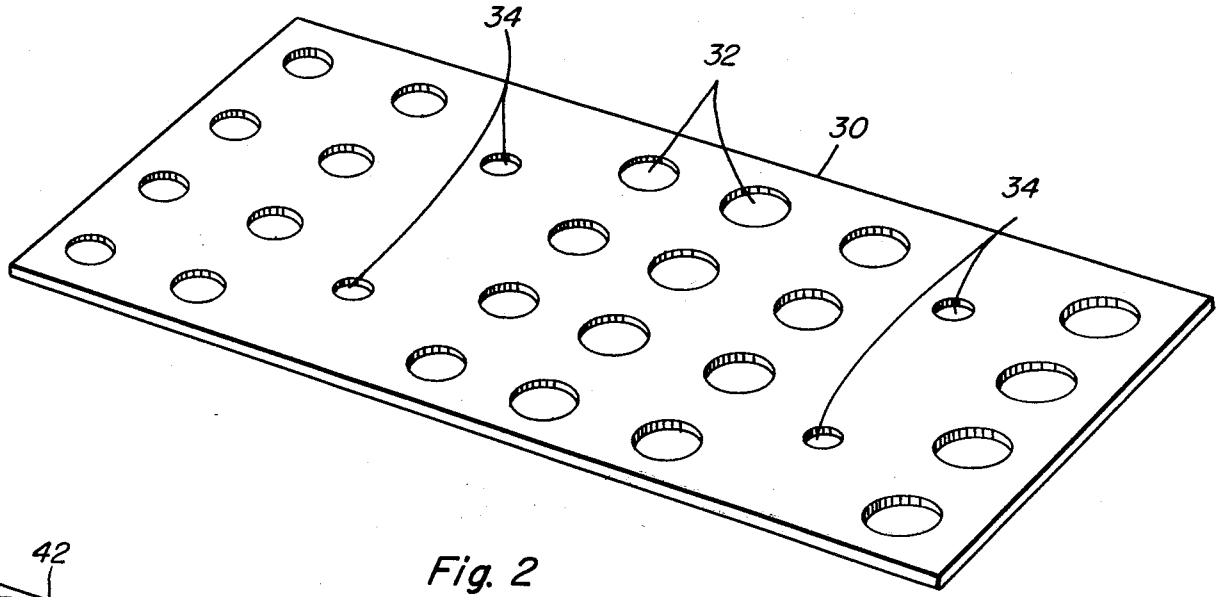
FIG. 2 is a plan view of the insulating sheet used with the keyboard according to the present invention.

FIG. 2 illustrates insulating spacer 30 which is positioned between first and second substrate 24 and 26, respectively. The thickness of the insulating spacer is in the range of two to fifteen mils, preferably three to ten mils. The insulating spacer 30 has a plurality of apertures or holes 32 which are in space alignment and registry with switch points 14. This can be seen more clearly in FIG. 5A. Insulating substrate 30 is utilized to ensure that undesirable electrical interconnections do not result. Insulating sheet 30 may be made from the same type of material as is flexible substrate 10. Registration holes 34 will be in line with the registration holes 20 in flexible substrate 10.

Figure 3:
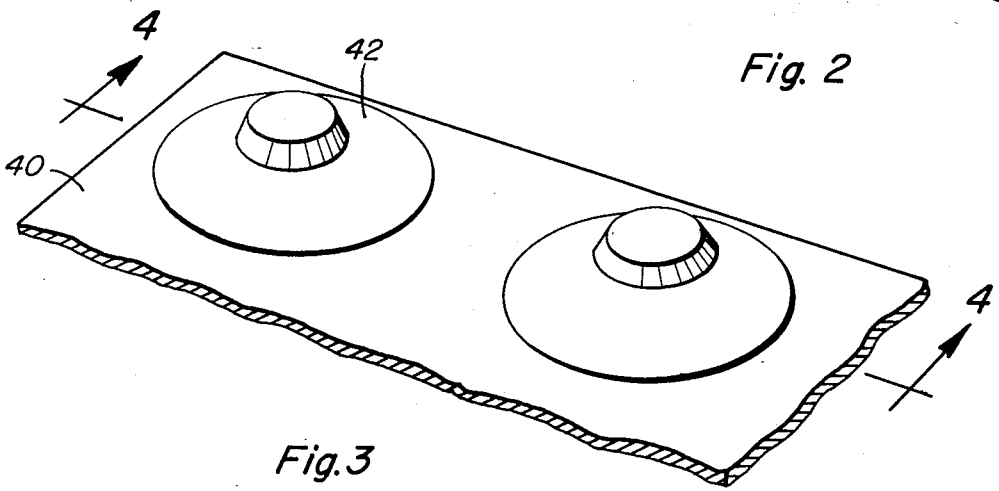
FIG. 3 is a plan view of an elastomer substrate which has a plurality of domes or protuberances selectively spaced thereon.
Figure 4:
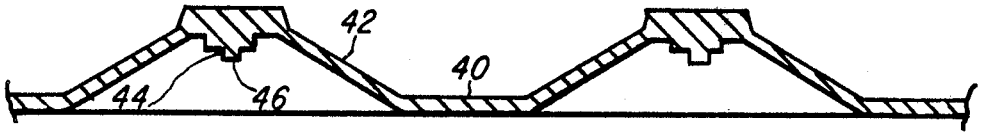
FIG. 4 is a sectional view taken along the line 4—4 of FIG. 3.

FIG. 3 illustrates an elastomer substrate 40 which has a plurality of protuberances or domes 42 located thereon which correspond in position to the location of switch points 14; and FIG. 4 illustrates a cross section of one of the domes 42 taken along the line 4—4 of FIG. 3. The substrate 40 is an elastomer or rubbery type material such as silicon rubber made by Sunarrow International and having a dome wall thickness of about five to fifty mils, preferably five to ten mils. The durometer of the elastomer on the Shore A scale is in the range of forty to hundred but preferably approximately seventy.

FIG. 4 shows a cross section of dome 42 and, in the preferred embodiment, the dome is in the form of a truncated cone; however, other geometric configurations may be equally satisfactory. On the underneath side of the truncated cone is an actuation point 44. The surface 46 of actuation point 44 ensures consistent and reliable contact of the switch points when a force is applied to dome 42.

Figure 5A:
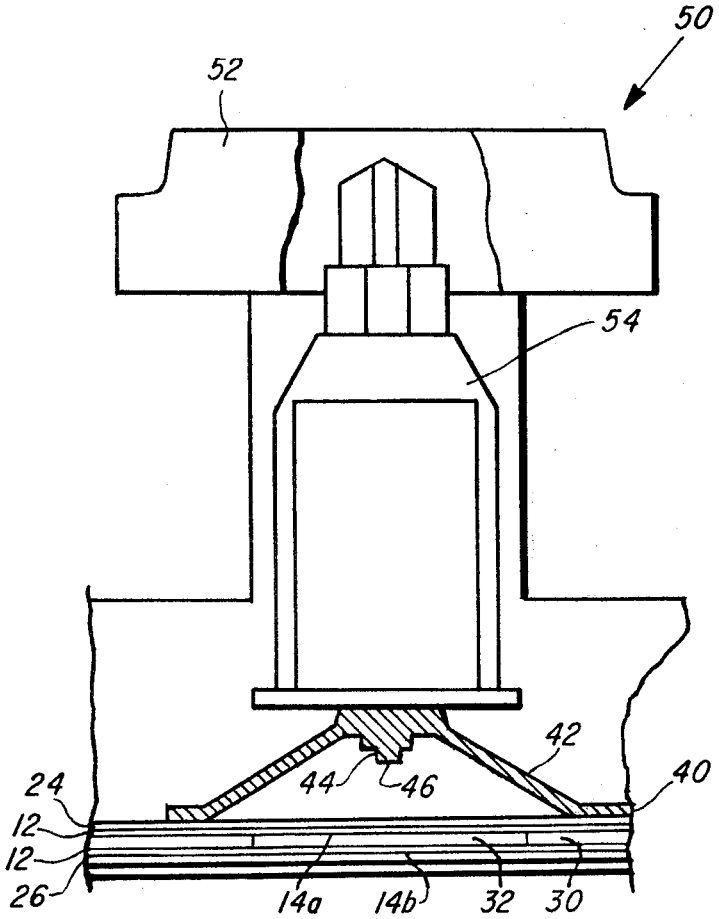
FIG. 5A is a cross sectional view of the keyboard constructed according to the present invention and with the elastomer dome in its rest or non-deformed position.

FIG. 5A shows a cross section view of the keyboard constructed according to the present invention. The keyboard 50 is comprised of elastomer substrate 40 having domes 42 extending therefrom. Substrate 40 is positioned on top of first flexible substrate member 24 having conducting stripes 12 and switch point 14*a* located on the bottom surface of the substrate. Second flexible substrate 26 has conducting stripes 12 and switch point 14*b* located on its top surface. Positioned between first and second flexible substrates 24 and 26 is an insulating spacer 30 which has a plurality of apertures 32 overlying switch points 14*a* and 14*b* to ensure that undesired and unwanted electrical connections are not made. The domes 42, apertures 32 in the insulating spacer 30, and the switch points 14*a* and 14*b* are all in line. Individual data entry keys 52 either are placed directly on top of dome 42 or are separated from the domes by a plunger which in turn is connected to data entry key 52.

Figure 5B:
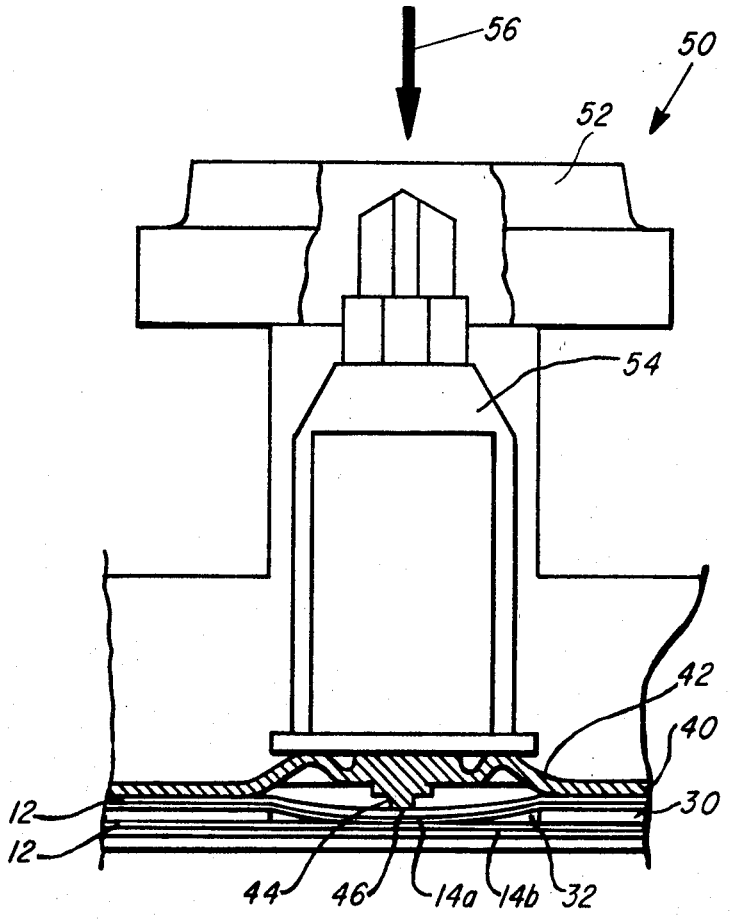
FIG. 5B is a cross sectional view of the keyboard showing the elastomer dome in its deformed position and the switch contact closed.

FIG. 5B illustrates the action of elastomer dome 42 when a force 56 is applied (such as the finger of a keyboard operator). As force 56 is applied to dome 42 (either through a data entry key, or a data entry key through an intermediate plunger, or directly to the dome), there is a force buildup until dome 42 reaches a breakover point. At that point, the force decreases and dome 42 collapses on top of flexible substrate 24. The actuation point 44 and surface 46 on the underneath side of dome 42 ensures that electrical contact is made between the switch point 14*a* located on the top substrate 24 with the switch point 14*b* located on the bottom substrate 26. The actuation point 44 and surface 46 ensure that a reliable and repetitive electrical contact is made. When force 56 is removed, elastomer dome 42 will snap back and be restored to its original position shown in FIG. 5A. It is critical that the length of the actuation point be of such a distance as to ensure depression of the flexible substrate in the deformed position. Other geometric configurations such as a cylindrical actuation surface, are equally acceptable. It has been experimentally determined that this type of switch is reliable in excess of five million cycles of the keyboard.

The type of keyboard described herein and constructed according to the present invention has a travel length in the range of 50–125 mils. This has been found to be a desirable travel distance, particularly for the keyboards associated with business calculators.

Although the present invention has been shown and illustrated in terms of a specific method and apparatus, it will be apparent that changes or modifications can be made without departing from the spirit and scope of the invention as defined by the appended claims.

What is claimed is:

1. A keyboard assembly comprising:

a first substrate having first switch points, a second flexible substrate having conducting stripes and second switch points, said first and second switch points facing one another in opposed complementary relation, an insulating spacer between said first and second substrates having a plurality of apertures in alignment with said first and second switch points, and a third substrate positioned over said second substrate and having a dome over the locations of each of said first and second switch points to be deformed to provide travel and tactile feedback when a force is applied to a dome for deforming a portion of the second substrate into a spacer aperture for pressing switch points of the first and second substrates together through the insulating spacer aperture, characterized in that the second substrate is formed of a first selected material for receiving said conductive stripes and switch points thereon and has a first selected thickness permitting repeated flexing deformation of the second substrate to a first selected extent over a long service life, the insulating spacer has a selected limited thickness permitting said second substrate portion to be repeatedly deformed to said first selected extent to press first and second switch points together through said insulating spacer apertures throughout said long service life, and said third substrate is formed of a second, elastomeric material and has each dome thereof proportioned to be deformed to a relatively much greater extent to provide long travel and high tactile feedback when said force is applied to a dome for deforming a portion of the second substrate into a spacer aperture for pressing said switch points of the first and second substrates together through the insulating spacer aperture throughout said long service life.

2. An assembly according to claim 1 further characterized in that said second flexible substrate comprises a material selected from the group consisting of polyester and polyimide films.

3. An assembly according to claim 1 further characterized in that said first and second flexible substrates are formed of a material selected from the group consisting of polyester and polyimide films.

4. An assembly according to claim 1 further characterized in that said spacer has a thickness in the range from 2 to 15 mils, the second substrate has a thickness in the range from 2 to 50 mils, said third substrate is formed of a rubber material having a durometer hardness in the range from 40 to 100 on the Shore A scale, and said dome is a truncated cone adapted to provide travel in the range from 50 to 125 mils upon deformation thereof.

5. An assembly according to claim 3 wherein said first and second flexible substrates are formed from one substrate folded back on itself.

6. An assembly according to claim 4 further characterized in that the thickness of the walls of said dome is in the range of five to ten mils.

7. An assembly according to claim 1 further comprising key means directly in contact with the upper portion of the truncated cone.

* * * * *